United States Patent [19]

Kawai et al.

[11] Patent Number: 5,076,764

[45] Date of Patent: Dec. 31, 1991

[54] SWASH PLATE TYPE COMPRESSOR

[75] Inventors: Katsunori Kawai; Takashi Okamoto; Shinichi Ishihara; Hitoshi Inuka, all of Kariya, Japan

[73] Assignee: Kabushiki Kaisha Toyoda Jidoshokki Seisakusho, Kariya, Japan

[21] Appl. No.: 575,314

[22] Filed: Aug. 30, 1990

[30] Foreign Application Priority Data

Sep. 5, 1989 [JP] Japan ..... 1-230607

[51] Int. Cl.[5] ..... F04B 1/12; F01M 1/00

[52] U.S. Cl. ..... 417/269; 91/499; 184/6.17

[58] Field of Search ..... 417/269, 270; 91/499; 184/6.17

[56] References Cited

U.S. PATENT DOCUMENTS

| | | | |
|---|---|---|---|
| 4,412,787 | 11/1983 | Kondo | 417/269 |
| 4,522,567 | 6/1985 | Kato | 417/270 |
| 4,717,313 | 1/1988 | Ohno | 417/269 |
| 4,746,275 | 5/1988 | Iwamori | 417/269 |
| 4,767,283 | 8/1988 | Ikeda | 184/6.17 |
| 5,009,286 | 4/1991 | Ikeda | 417/269 |

*Primary Examiner*—Richard A. Bertsch

*Assistant Examiner*—Peter Korytnyk

*Attorney, Agent, or Firm*—Brooks Haidt Haffner & Delahunty

[57] ABSTRACT

A swash plate type compressor having axially spaced inlet chambers and outlet chambers located on the side of angularly spaced pistons having each side thereof pump chambers which are connected to inlet chamber when the medium is introduced into the pump chambers, and are connected to the outlet chamber when the medium is removed to the outlet chambers. A swash plate chamber is arranged inside the cylinder block and cooperates with the pistons via respective shoes for reciprocating the pistons in the respective cylinder bores. An inlet of the fluid to be compressed is opened to the swash plate chamber at a circumferential position along the inner wall of the swash plate chamber. Communication passageways for connection of the swash plate chamber with the inlet chambers are arranged on position spaced farthest from the inlet port. The flow of the lubrication oil contained in the gas to be compressed is generated inside the swash plate chamber and comes into contact with all of the shoes, to lubricate same, before being introduced into the communication passageway from the swash plate chamber.

7 Claims, 9 Drawing Sheets

SWASH PLATE TYPE COMPRESSOR

BACKGROUND OF THE INVENTION

1. Field of the Invention

The present invention relates to a lubricating system for a swash plate type compressor.

2. Description of the Related Art

Known in the prior art is a swash plate type compressor wherein a plurality of angularly spaced apart cylinder bores are formed in a stational cylinder block, pistons are axially slidably inserted into the cylinder bores, respectively, and at an axially central position of the cylinder block, a swash plate chamber is formed in which a swash plate is arranged (See U.S. Pat. No. 4,746,275 and U.S. Pat. No. 4,717,313). The swash plate is fixedly mounted to a drive shaft, and is connected to the middle portions of the pistons via respective shoes, so that the pistons are axially reciprocated in the respective cylinder bores in accordance with the rotation of the drive shaft. Pump chambers are formed on both ends of each of the pistons in the corresponding cylinder bore, and inlet chambers are formed at the sides of the cylinder block and are connected to the respective piston chambers for introducing a medium to be compressed when the movement of the respective pistons increases the volume of the pump chambers. Outlet chambers are formed on the sides of the cylinder block, concentrically to the inlet chambers, and are connected to the respective piston chambers for allowing the compressed fluid medium to be forced out of the piston chambers when the movement of the pistons reduces the volume of the pump chambers. An inlet port is opened to the swash plate chamber to allow an introduction of the medium to be compressed, and a plurality of angularly spaced inlet passageways are formed in the cylinder block and between the adjacent cylinder bores along the circumferential direction of the cylinder block. The inlet passageways connect the swash plate chamber to the inlet chambers.

A high speed sliding movement occurs between the swash plate and shoes under a compression reaction force, and thus a good lubrication of the shoes is very important. The cooling medium to be compressed contains a lubricant, and thus the lubricant is introduced into the swash plate chamber in an atomized condition and supplied to the shoes. The inlet port, however, is connected to the cylinder block at a position along the circumference of the swash plate chamber but the shoes are distributed along the entire circumference of the swash plate chamber, and as a result, the oil is apt to be locally supplied to the shoe located nearest the inlet port, and the lubrication of the remaining shoes located away from the inlet port is poor.

SUMMARY OF THE INVENTION

According to the present invention, a swash plate type compressor is provided comprising, a housing, a cylinder block fixedly mounted in the housing, and a drive shaft having a longitudinally extending axis.

The cylinder block defines circumferentially spaced cylinder bores, each extending along the direction parallel to the axis, a plurality of pistons are axially slidably inserted into the respective cylinder bores, and pump chambers are formed at the axial sides of each of the pistons in the respective cylinder bores.

First and second inlet chambers are located on the sides of the respective cylinder blocks remote from the pistons, for an introduction into the pump chambers of a medium to be compressed; these first and second inlet chambers being in communication with the adjacent pump chambers for the introduction into the pump chambers of the medium to be compressed.

First and second outlet chambers are located on the side of the respective cylinder block remote from the piston, the outlet chambers being located radially concentric to the respective inlet chambers, and these first and second outlet chambers are in communication with the pump chambers for a removal of the compressed medium from the pump chamber.

A swash plate is fixedly mounted on the drive shaft and cooperates with the pistons in such a manner that the rotation of the drive shaft causes a reciprocating movement of the pistons in the respective cylinder bores, to thereby cause the volume of the first and second piston chambers to be varied in accordance with the direction of movement of the pistons in the cylinder bores.

The cylinder block defines a cylindrical recess located between the first and second pump chambers along the direction of the axis of the drive shaft, which recess serves as a swash plate chamber for housing the swash plate and shoe members for allowing a slidable connection of the swash plate to the pistons.

The cylinder block also defines an inlet conduit for an introduction of a lubrication oil, contained in the medium to be compressed into the swash plate chamber, this inlet conduit being opened to the swash plate chamber at a position along a circumference of said recess.

Further, means are provided for defining axially extending communication passageways which communicate the swash plate chamber with the first and second inlet chambers, respectively, the communication passageways being located on the circumference about the axis of the drive shaft, and substantially the most distant with respect to the location at which the inlet conduit is opened to the swash plate chamber, whereby at least the main part of the fluid is introduced into the inlet chambers via said communication passageways.

DESCRIPTION OF THE PREFERRED EMBODIMENTS

Figure 1:
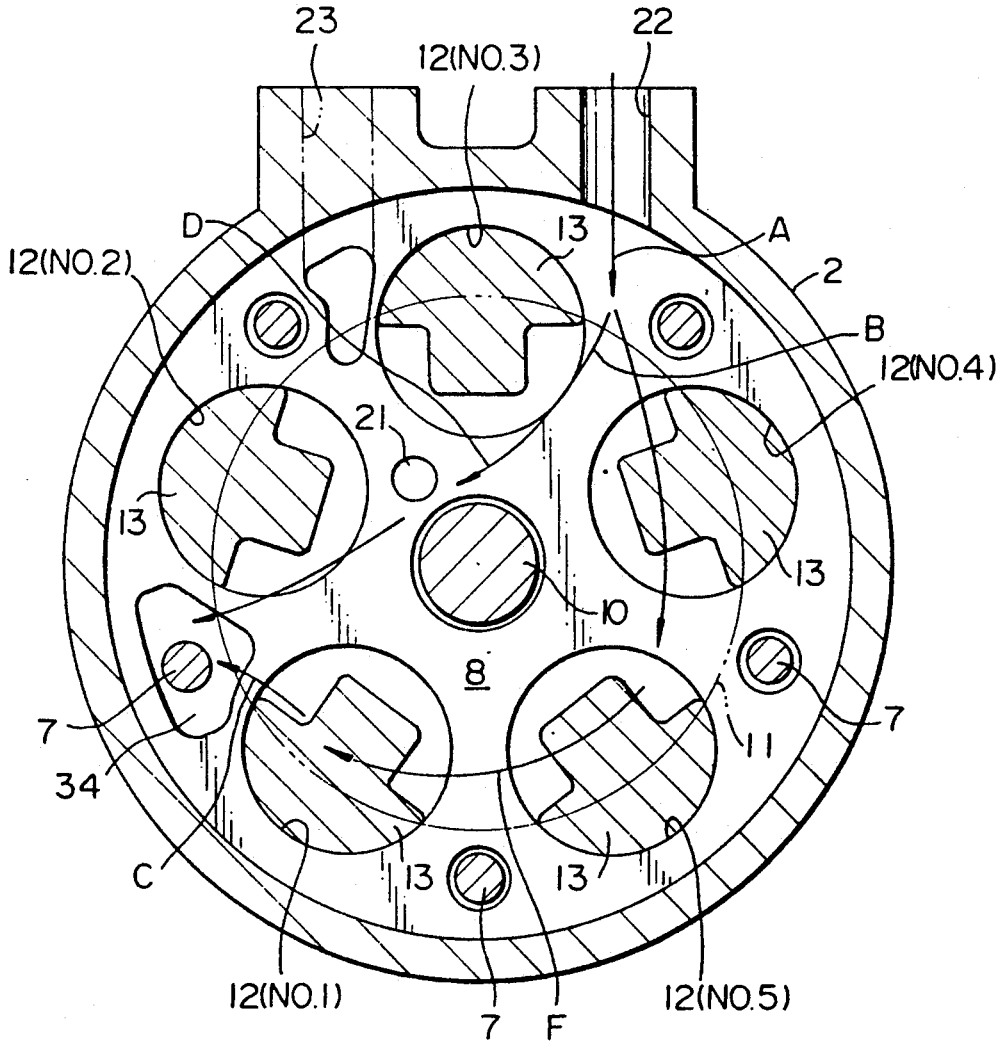
FIG. 1 is a transverse cross sectional view of the first embodiment of the compressor according to the present invention, taken along a line I—I in FIG. 2.
Figure 2:
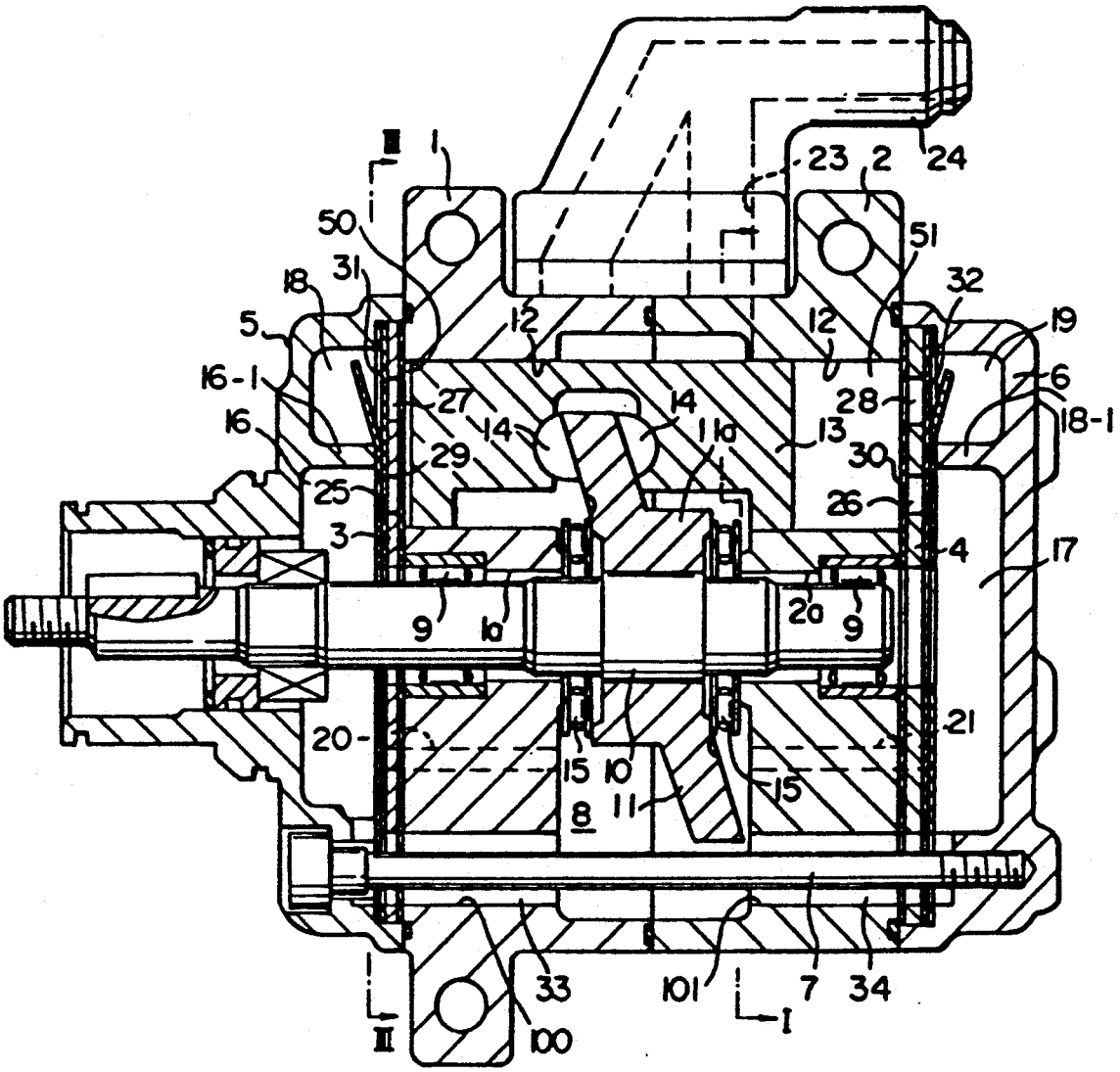
FIG. 2 is a longitudinal cross sectional view of the first embodiment of the compressor according to the present invention, taken along a line II—II in FIG. 3.
Figure 3:
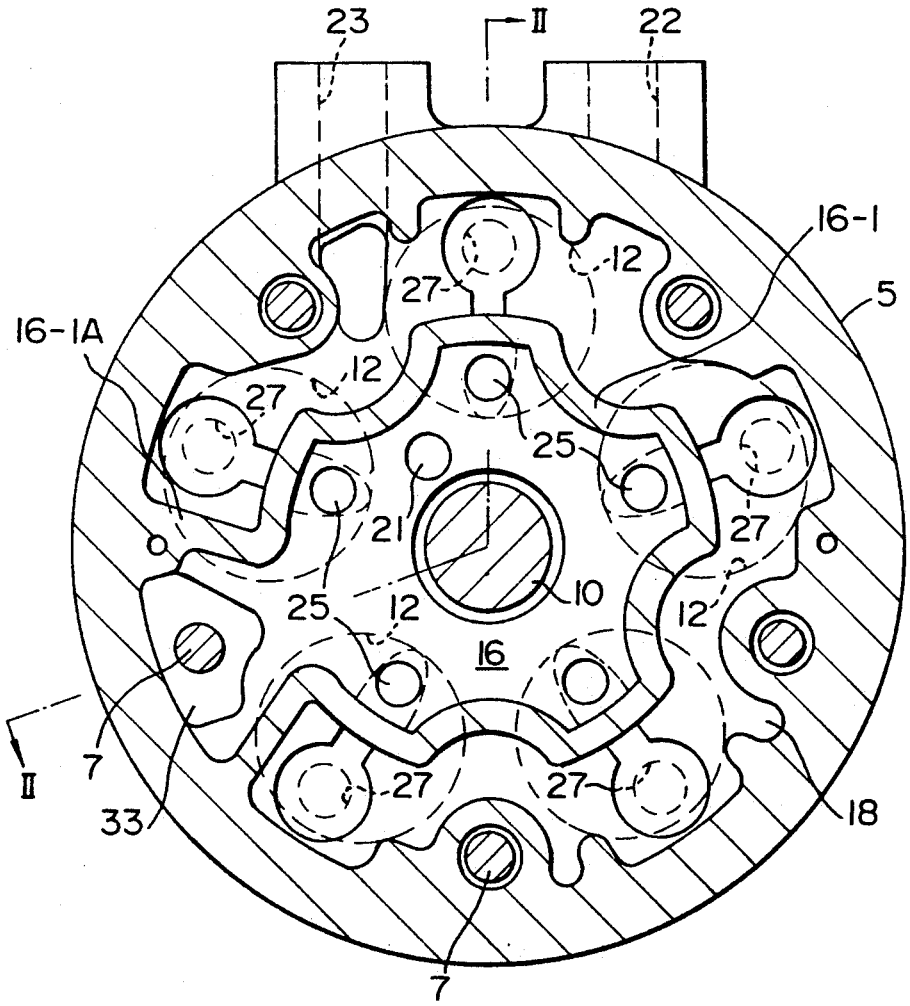
FIG. 3 is a transverse cross sectional view of the first embodiment of the compressor according to the present invention, taken along a line III—III in FIG. 2.

In the first embodiment of the compressor according to the present invention as shown in FIGS. 1, 2 and 3, reference numerals 1 and 2 denote cylinder block members, 3 and 4 valve plates, and 5 and 6 front and rear housings; these parts are connected to each other by a plurality of spaced bolts 7. A swash plate chamber 8 is formed between the cylinder block members 1 and 2, and a swash plate 11 is arranged in the swash plate chamber 8. The swash plate 11 is mounted on a drive shaft 10 which is rotatably supported by a pair of radial bearings 9 fitted to a pair of axial openings 1*a* and 2*a* formed in the cylinder block members 1 and 2, respectively. The cylinder block members 1 and 2 form five pairs of axially aligned cylinder bores 12 extending in parallel to the axis of the drive shaft 10 and circumferentially spaced along the circumference of the cylinder block members 1 and 2. First and second piston chambers 50 and 51 are formed at the sides of each of the pistons 13 in the cylinder bores 12, and the swash plate 11 is connected to the pistons 13 by shoes 14, whereby an axially reciprocating movement of the pistons 13 is obtained in the cylinder bores 12 to thereby change the volume of the piston chambers 50 and 51 and obtain an expansion and compression of the gas medium therein. Thrust bearings 15 are arranged between a boss portion 11*a* of the swash plate 11 and the cylinder block members 1 and 2.

Inlet chambers 16 and 17 located around the drive shaft 10 are formed between the housing 5 and the cylinder block member 1 and between the housing 6 and the cylinder block member 2, respectively, and are connected to the pump chambers 50 and 51, via inlet ports 25 and 26, respectively, formed in the valve plates 3 and 4, respectively. Located radially coaxially outside of the inner inlet chambers 16 and 17 are outlet chambers 18 and 19, which are also formed between the housing 5 and the cylinder block member 1 and between the housing 6 and the cylinder block member 2, respectively. The outlet chambers 18 and 19 are connected to the pump chambers 50 and 51, respectively, via outlet ports 27 and 28, respectively.

Inlet valves 29 and 30 are mounted on the valve plates 3 and 4, respectively at the side thereof nearest to the cylinder bores 12, for opening the inlet ports 25 and 26 when the cooling medium is introduced into the pump chambers 50 and 51, and closing the inlet ports 25 and 26 when the cooling medium is forced out from the pump chambers 50 and 51. Outlet valves 31 and 32 are connected to the valve plates 3 and 4, respectively, on the side thereof farthest from the cylinder bores 12, for opening the outlet opening when the cooling medium is forced out from the pump chambers 50 and 51, and closing the pump chambers 50 and 51 when the volume of the corresponding pump chambers 50 and 51 is increased.

A flange plate 24 is connected to the cylinder block members 1 and 2, and is provided with an inlet port 22 and an outlet port 23. The inlet port 22 is opened at the inner end thereof to the swash plate chamber 8, as shown in FIG. 1, for introducing the cooling medium to be compressed and containing the lubrication oil into the swash plate chamber 8. The outlet port 23 is open at the inner end thereof to the outlet chamber 18 and 19, for removing the compressed medium from the outlet chambers 18 and 19. The inlet port 22 and outlet port 23 are connected at the outer ends thereof to a cooling system, not shown in the drawings.

The compressor according to the present invention includes a construction for obtaining an even distribution of lubrication oil in the swash plate chamber 8, to ensure an effective lubrication of all of the shoes 14 and pistons 13 regardless of the positions thereof with respect to the inlet port 22. As shown in FIG. 3, the front housing 5 has an inner partition 16-1 which is extended from the inner end wall toward the facing valve plate 3, so that the inlet chamber 16 is formed inside the partition 16-1 and the outlet chamber 18 is formed outside the partition wall 16-1. The partition wall 16-1 has portions 16-1A which are connected to the body portion of the housing 5, and allow the inlet chamber 16 to be connected to a bore 100 through which the bolt 7, located substantially opposite to the inlet port 22, is passed. The diameter of the bolt bore 100 is such that an inlet passageway 33 is formed therein for connecting the swash plate chamber 8 to the inlet chamber 16. The same construction is used for the rear housing 6, whereby the swash plate chamber 8 is connected to the rear inlet chamber 17 via an inlet passageway 34 formed by a bolt bore 101 used for an introduction of the bolt 7 and located substantially opposite to the inlet port 22 with respect to the drive shaft 10, in the plane transverse to the axis of the drive shaft 10.

In the first embodiment, an axially extending auxiliary inlet passageway 20 is provided in the cylinder block member 1 for connecting the swash plate chamber 8 with the front inlet chamber 16, and an axially extending auxiliary inlet passageway 21 is provided in the cylinder block member 2 for connecting the swash plate chamber 8 with the rear inlet chamber 17. These inlet passageways 20 and 21 are located in an angular position between the adjacent cylinder bores 12 next to the inlet port 22, which is spaced from the inlet port 22 with respect to the direction of rotation of the swash plate, as shown by an arrow F, in the plane transverse to the axis of the drive shaft 10.

The lubrication operation of the first embodiment will be described hereinbelow. The cooling medium from the not shown cooling system is introduced into the swash plate chamber 8 via the inlet port 22, and the rotation of the drive shaft 10 causes the swash plate 11 to rotate so that the pistons 13 are axially reciprocated in the cylinder bores 12, which causes the volume of the piston chambers 50 and 51 to be alternately increased or decreased. When the movement of the pistons 13 is such that the volume of the piston chambers 50 is increased the cooling medium in the swash plate chamber 8 is introduced via the inlet passageways 20 and 33, inlet chamber 16, and the valve port 25, into the pump chambers 50, or via the inlet passageways 21 and 34, inlet chamber 17 and valve port 26, into the pump chamber 50. Conversely, when the movement of the pistons 13 is such that the volume of the piston chambers 50 is decreased, the cooling medium in the piston chambers 50 is exhausted, via the outlet ports 27, into the outlet chamber 18, and via the outlet ports 28 into the outlet chamber 19. The cooling medium from the outlet chambers 18 and 19 is introduced into the cooling system (not shown) via the outlet port 23.

A major part of the cooling gas medium introduced into the swash plate chamber 8 from the inlet port 22, as shown by an arrow A, flows in the clockwise direction as shown by arrows B and F, due to the air flow generated by the rotation of the swash plate 11, and is introduced into the inlet passageway 33 or 34 located, substantially opposite to the inlet port 22, as shown by an arrow C, while coming into contact with pistons No. 4, No. 5, and No. 1. A remaining part of the cooling gas medium, not effected by the rotation of the swash plate 11, is directly introduced to the passageways 20 or 21 and 33 or 34, as shown by an arrow D, so that the gas flow comes into contact with No. 3 and No. 2 cylinders. As will be clear from the above, the cooling medium introduced into the swash plate chamber 8 is evenly brought into contact with the all of the pistons 13, and accordingly, into contact with the shoes 14 connecting the pistons 13 to the swash plate 11, prior to the introduction of the medium into the inlet chambers 16 and 17, and as a result, an effective lubrication of the sliding parts of the shoes 14 is obtained.

Contrary to this, in the prior art, only a plurality of spaced inlet passageways are provided in the cylinder block members, for connecting the swash plate chamber and the inlet chambers, and the inlet passageway 34 is not provided. As a result, the lubricant contained in the cooling medium is apt to be concentrated at the inlet passageway located nearest the inlet port in the direction of rotation of the swash plate 11, and thus a good lubrication of the shoes located remote from the inlet port is not obtained. According to the present invention, as explained above, the provision of the passageway 34 at a position substantially opposite to the inlet port 22 allows a generation of a flow of the cooling medium from the inlet port 22 to the inlet passageway 34 in the swash plate chamber 8, which ensures that the flow of the cooling medium containing the lubricant comes into contact with all of the shoes 14 and pistons 13, before being introduced into the inlet chambers 16 and 17, to thereby obtain an ideal lubrication of the sliding portions of the compressor.

Figure 4:
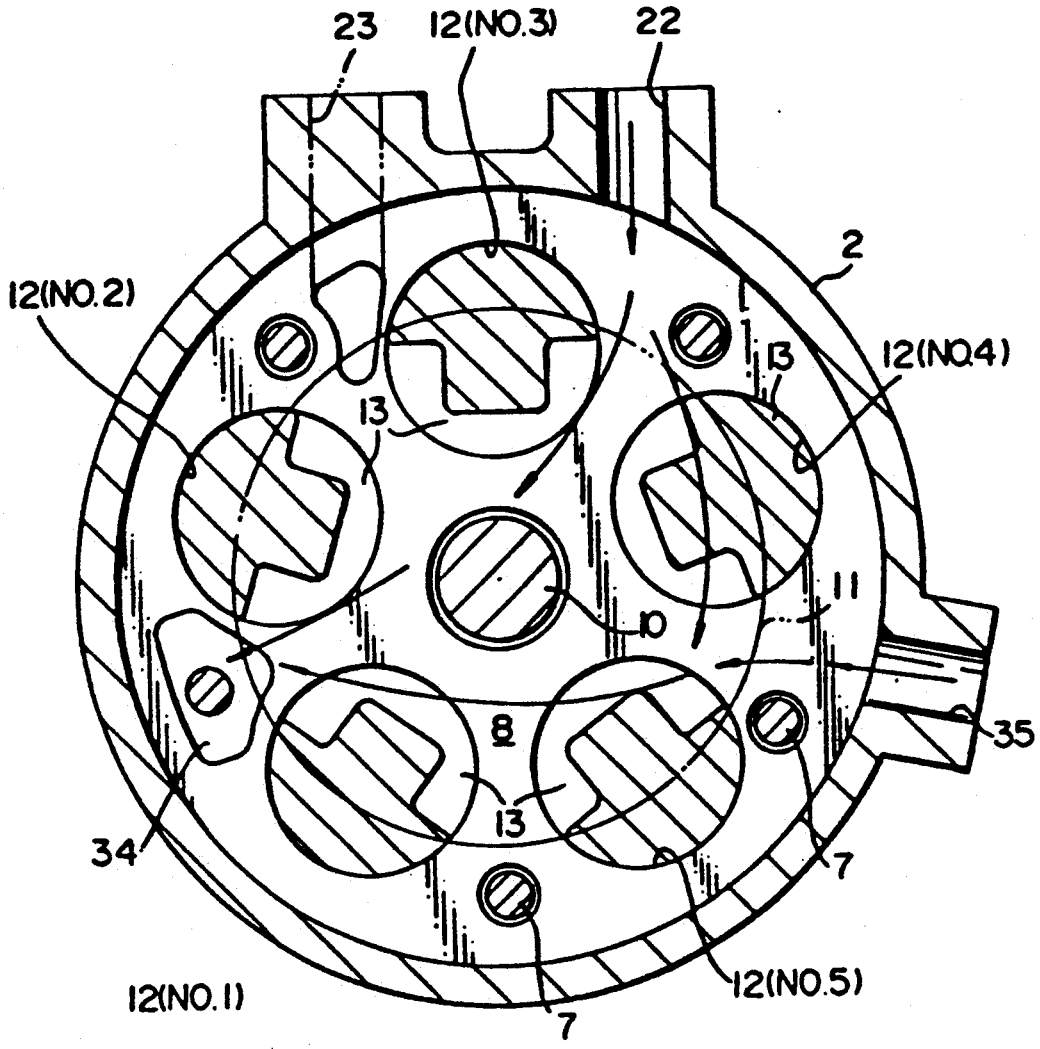
FIGS. 4 and 5 are similar to FIGS. 1 and 3, but show the third embodiment of the compressor according to the present invention.
Figure 5:
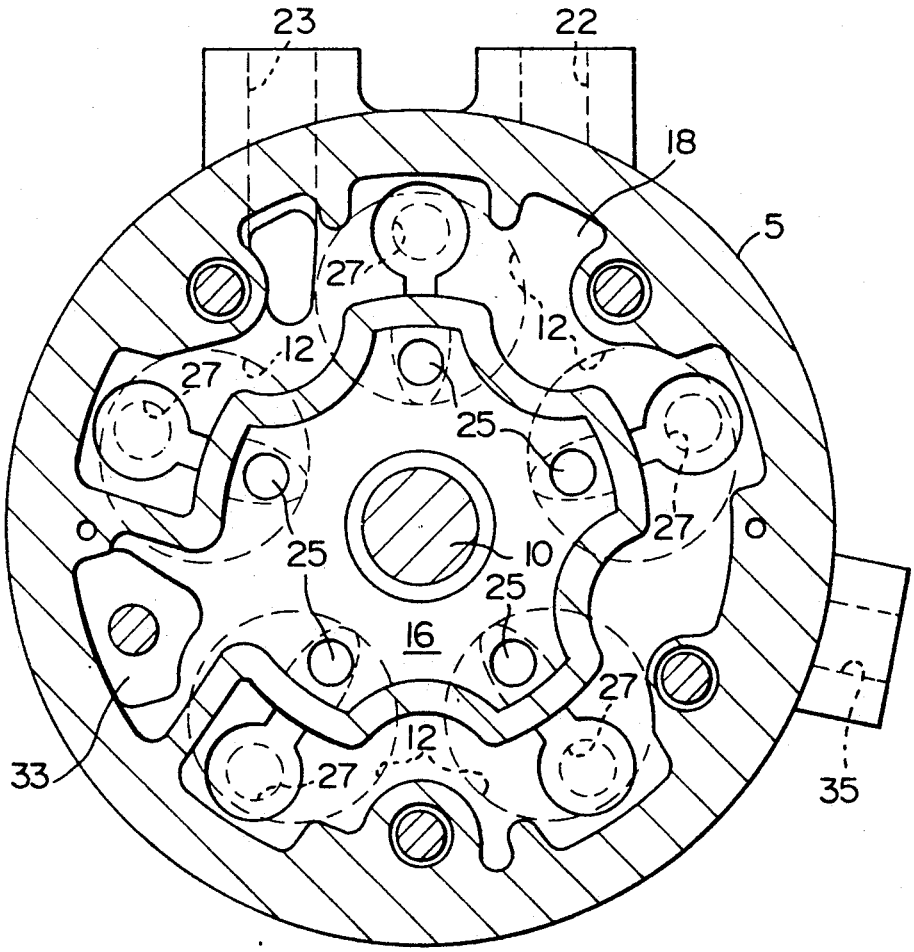

FIGS. 4 and 5 show a second embodiment, which is different from the first embodiment shown in FIGS. 1 to 3 in that the axially extending passageways 20 and 21 located at an angular position between the No. 2 and No. 3 cylinders, for communication of the swash plate chamber 8 and inlet chambers 16 and 17 are eliminated, and a second inlet port 35 for introducing recirculated cooling gas into the swash plate chamber 8 is provided at a position such that the port 35 is located symmetrical to the inlet port 22 with respect to the plane parallel to the axis of the drive shaft 10, and passing the axis of the drive shaft and the axis of the passageways 33 and 34. The remaining construction is the same as that in the first embodiment.

In the second embodiment, the cooling medium gas introduced into the swash plate chamber from the inlet ports 22 and 35 is constrained in the swash plate chamber 8 until it has passed all of the locations at which the pistons 13 and shoes 14 are arranged, and has reached the inlet passageways 33 and 34, and as a result, all of the pistons 3 and shoes 14 in the swash plate chamber 8 are evenly lubricated. The symmetrical arrangement of the inlet ports 22 and 35 with respect to the plane parallel to the axis of the shaft and passing through the drive shaft 10 and the inlet passageways 33 and 34 enables a much more evenly distributed flow of the cooling medium gas in the swash plate chamber 8 to be obtained than that obtained by the first embodiment, to thereby obtain a more even lubrication of the pistons 13.

Figure 6:
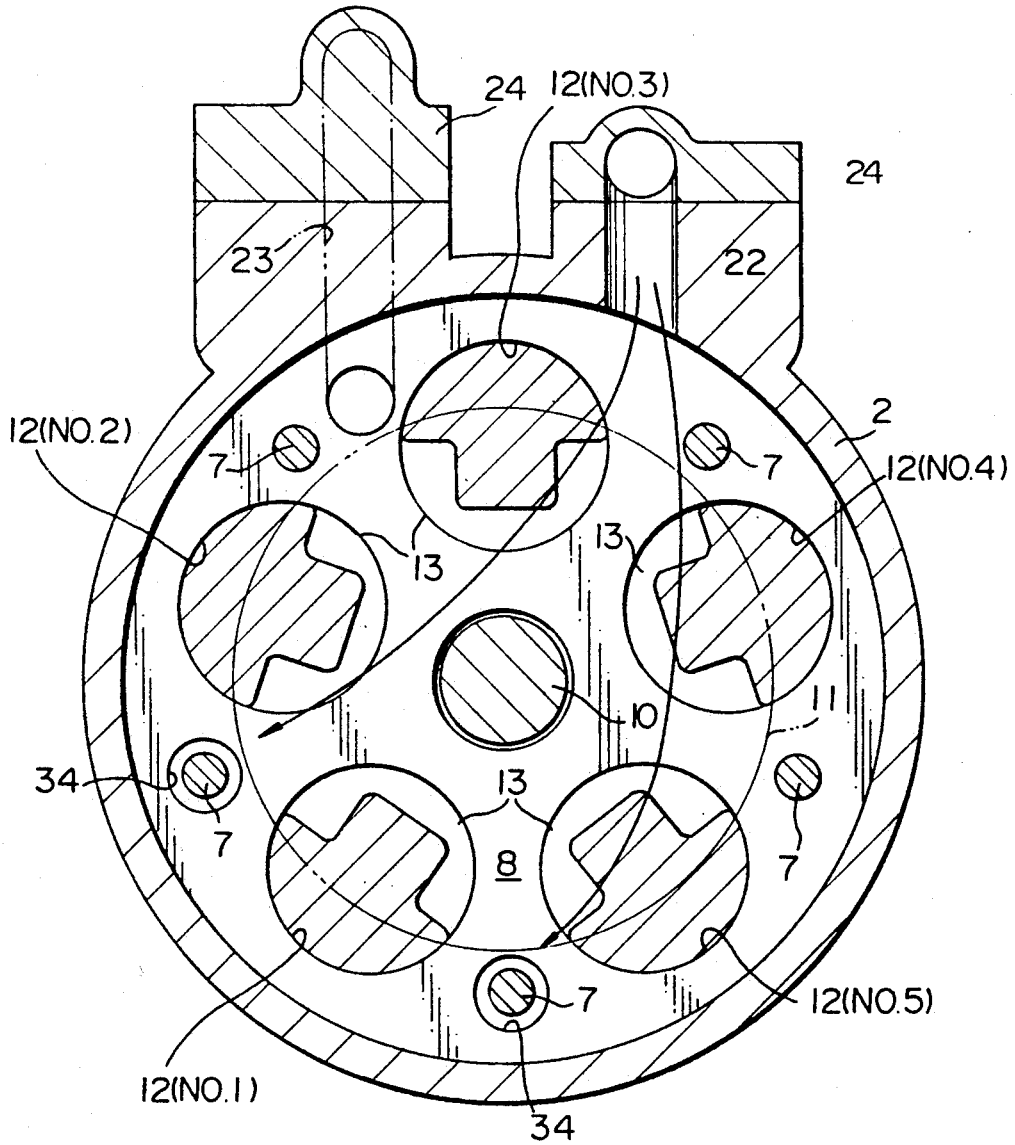
FIGS. 6, 7 and 8 are similar to FIGS. 1, 3 and 2, but show the fourth embodiment of the compressor according to the present invention; and, FIG. 9 is similar to FIG. 3, but shows another embodiment of the compressor according to the present invention.
Figure 7:
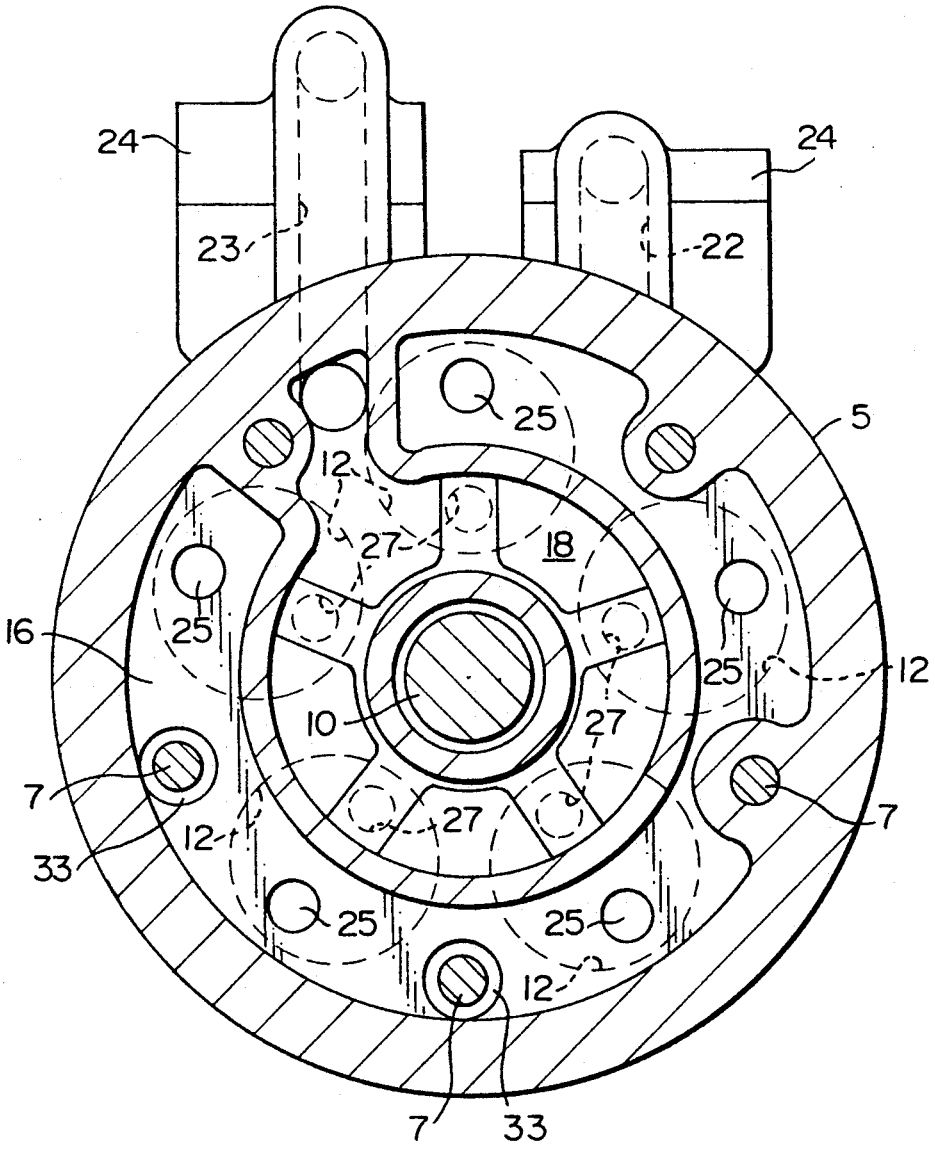
Figure 8:
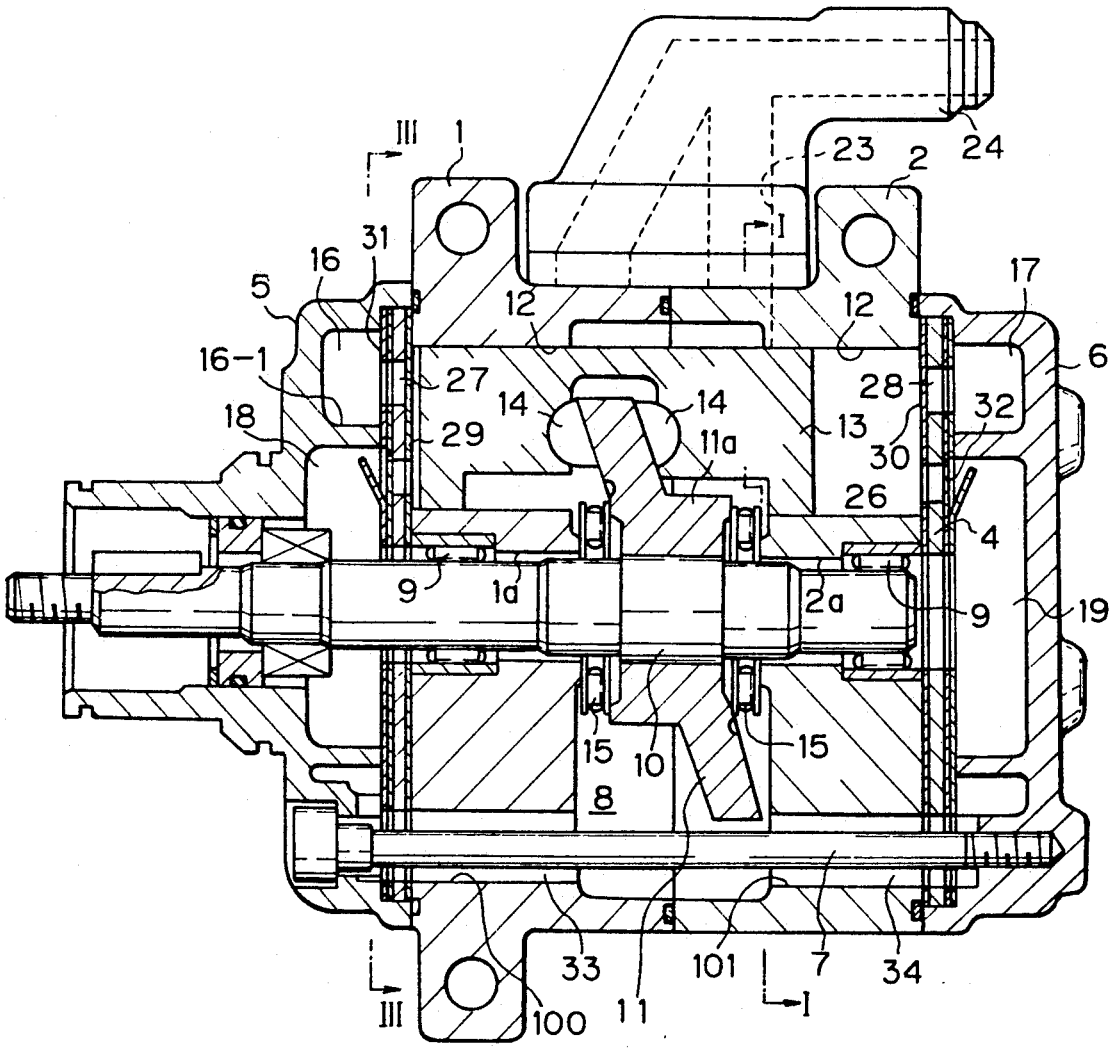

FIGS. 6, 7, and 8 show an embodiment which illustrates an application of the present invention to a compressor wherein the outlet chambers 18 and 19 are located inside of the inlet chambers 16 and 17. Furthermore, the bores for the two bolts 7 located most distant from the inlet port 22 extending axially between the sides of the first cylinder bore 12 have a larger diameter, to thereby create passageways 34 for communicating the swash plate chamber 8 with the inlet chambers 16 and 17.

The cooling medium gas introduced into the swash plate chamber 8 from the inlet port 22 flows as shown by arrows in FIG. 6, and this flow passes and comes into contact with all of the pistons 13 and the shoes 14, before entering the inlet passageways 33 and 34, so that the atomized lubrication oil contained in the cooling medium gas evenly lubricates all of the pistons 13 and shoes 14, to obtain a desired lubrication of the portions at which a sliding movement occurs.

Figure 9:
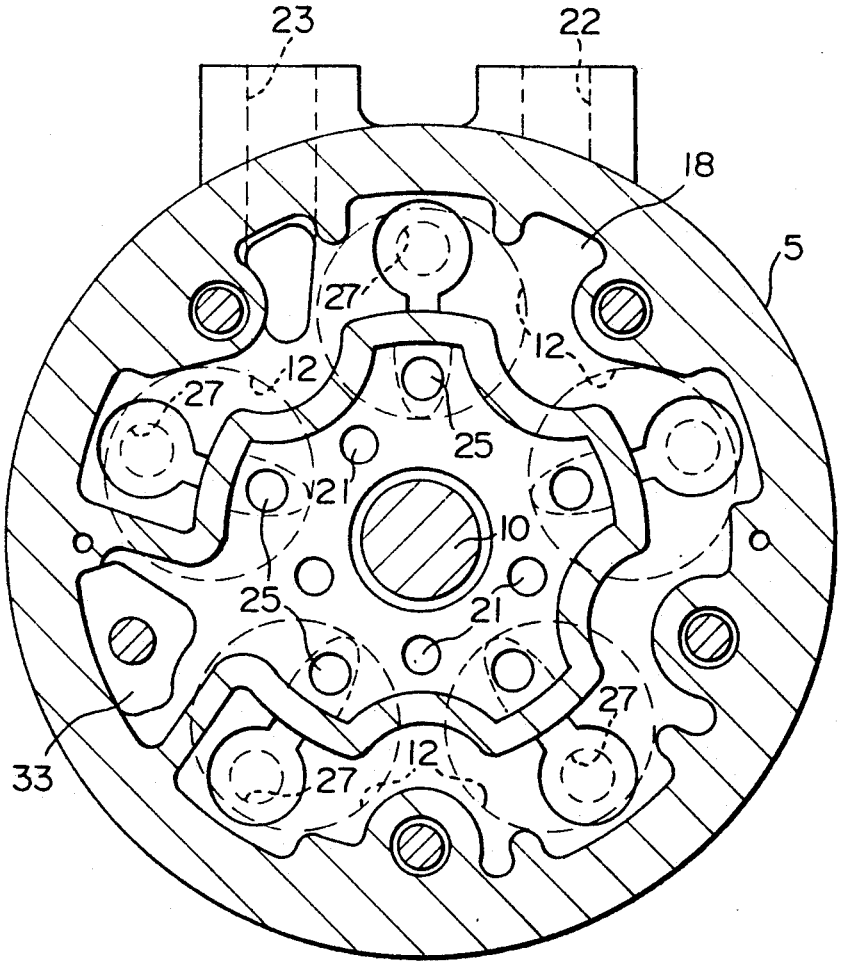

FIG. 9 shows another embodiment, wherein inlet passageways axially extending between the adjacent cylinder bores 12 are provided except at a position most adjacent to the inlet port 12, in the direction of the rotation of the swash plate.

Furthermore, in the construction where the outlet chambers 18 and 19 are arranged inside of the inlet chambers 16 and 17, as shown by FIGS. 6, 7 and 8 (the third embodiment), as in the second embodiment in FIGS. 4 and 5, an inlet port can be provided symmetrically to the inlet port 25 with respect to the plane including the axis of the drive shaft, and passing through the axis of the drive shaft and axis of the inlet passageway 33 and 34 formed by bolt holes located substantially opposite to the inlet port 25.

Furthermore, the present invention can be applied to a variable displacement type swash plate type compressor.

Although the embodiments of the present invention are described with reference to the attached drawings, many modifications and changes can be made by those skilled in this art, without departing from the scope and spirit of the present invention.

What is claimed is:

1. A swash plate type compressor, comprising:

a housing;

a cylinder block fixedly mounted in said housing;

a drive shaft having a longitudinally extending axis;

said cylinder block defining circumferentially spaced cylinder bores each extended in parallel to said axis;

a plurality of pistons axially and slidably inserted into the respective cylinder bores;

pump chambers formed on the axial sides of each of the pistons in the respective cylinder bores;

first and second inlet chambers located on the sides of the respective cylinder blocks remote from the pistons, for introducing a cooling medium to be compressed into the pump chambers, said first and second inlet chambers communicating with the adjacent pump chambers, for an introduction of the medium to be compressed into the pump chambers;

first and second outlet chambers located on the side of the respective cylinder block remote from the piston, the outlet chambers being located radially concentric to the respective inlet chambers, said first and second outlet chambers communicating with the pump chambers for a removal of the compressed medium from the pump chamber;

a swash plate fixedly mounted on the drive shaft and cooperating with the pistons in such a manner that the rotation of the drive shaft causes the pistons to reciprocate in the respective cylinder bores, causing the volume of the first and second piston chambers to be varied in accordance with the direction of movement of the pistons in the cylinder bores;

said cylinder block defining a cylindrical recess located between the first and second pump chambers along the direction of the axis of the drive shaft, to thereby create a swash plate chamber for housing said swash plate;

shoe members for enabling a slidable connection of the swash plate to the pistons;

said cylinder block defining an inlet conduit for introduction of lubrication oil contained in a cooling medium to be compressed into the swash plate chamber, said inlet conduit being opened to the swash plate chamber at a position along a circumference of said recess;

means for defining axially extending communication passageways for communicating the swash plate chamber with the first and second inlet chambers, respectively, said communication passageway being located on the circumference about the axis of the drive shaft, which is substantially the most distant with respect to the location at which the inlet conduit is opened to the swash plate chamber, said communication passageway being in said cylinder block in a position between those of said cylinder bores remote from the inlet conduit, whereby at least the main part of the fluid is introduced into the inlet chambers via said communication passageways.

2. A compressor according to claim 1, wherein said cylinder block further defines a pair of auxiliary passageways which are located adjacent to the inlet port in the direction opposite to the rotation of the swash plate and extend axially between the adjacent cylinders, the auxiliary passageways connecting the swash plate with the respective inlet chambers.

3. A compressor according to claim 1, wherein said cylinder block further defines a plurality of circumferentially spaced pairs of auxiliary passageways which are located at positions other than a position adjacent to the inlet port in the direction opposite to the rotation of the swash plate and extend axially between the adjacent cylinders, the auxiliary passageways connecting the swash plate with the respective inlet chambers.

4. A compressor according to claim 1, wherein said cylinder block further defines a second inlet conduit for an introduction of lubrication oil contained in a cooling medium to be compressed into the swash plate chamber, said inlet conduit being opened to the swash plate chamber at a position along a circumference of said recess in such a manner that the first and second inlet conduits are symmetrical to the plane passing in parallel through the axis of the drive shaft and the axis of the communication passageway.

5. A compressor according to claim 1, wherein said inlet chambers are located radially inside of the outlet chambers.

6. A compressor according to claim 1, wherein said inlet chambers are located radially outside of the outlet chambers.

7. A compressor according to claim 1, wherein the cylinder block comprises two axially divided members, and bolts for mechanically connecting the members with each other, the divided members having a plurality of angularly spaced bolt openings through which the respective bolts are inserted, said communication passageways being formed by the clearances formed between the bolts and openings.

* * * * *

UNITED STATES PATENT AND TRADEMARK OFFICE

CERTIFICATE OF CORRECTION

PATENT NO. : 5,076,764

DATED : December 31, 1991

INVENTOR(S) : K. Kawai et al

It is certified that error appears in the above-identified patent and that said Letters Patent is hereby corrected as shown below:

Col. 4, line 63, after "located" delete comma ",".

Col. 5, line 5, after "with" delete "the".

Col. 7, line 25, after "between" delete "those", insert --two--.

Signed and Sealed this

Twenty-first Day of September, 1993

Bruce Lehman

*Attest:*

BRUCE LEHMAN

*Attesting Officer*

*Commissioner of Patents and Trademarks*